US006405548B1

(12) United States Patent
Hollenbeck

(10) Patent No.: US 6,405,548 B1
(45) Date of Patent: Jun. 18, 2002

(54) METHOD AND APPARATUS FOR ADJUSTING TEMPERATURE USING AIR FLOW

(75) Inventor: Robert Keith Hollenbeck, Fort Wayne, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/637,219

(22) Filed: Aug. 11, 2000

(51) Int. Cl.[7] ..... F25D 17/04
(52) U.S. Cl. ..... 62/186; 62/408
(58) Field of Search ..... 62/179, 180, 186, 62/187, 408, 409, 155, 157, 158, 234, 231

(56) References Cited

U.S. PATENT DOCUMENTS

| | | | | |
|---|---|---|---|---|
| 3,659,429 | A | | 5/1972 | McClean |
| 3,747,361 | A | | 7/1973 | Harbour |
| 3,759,053 | A | | 9/1973 | Swaneck, Jr. |
| 3,918,269 | A | | 11/1975 | Summers et al. |
| 4,002,199 | A | | 1/1977 | Jacobs |
| 4,009,589 | A | | 3/1977 | Webb et al. |
| 4,009,591 | A | | 3/1977 | Hester |
| 4,326,390 | A | | 4/1982 | Brooks |
| 4,358,932 | A | | 11/1982 | Helfrich, Jr. |
| 4,368,622 | A | | 1/1983 | Brooks |
| 4,371,819 | A | | 2/1983 | Kaufmann |
| 4,383,421 | A | | 5/1983 | Quesnoit |
| 4,385,075 | A | | 5/1983 | Brooks |
| 4,537,041 | A | | 8/1985 | Denpou et al. |
| 4,553,584 | A | | 11/1985 | Bloomquist |
| 4,555,057 | A | | 11/1985 | Foster |
| 4,623,827 | A | | 11/1986 | Ito |
| 4,662,185 | A | | 5/1987 | Kobayashi et al. |
| 4,732,009 | A | | 3/1988 | Frohbieter |
| 4,841,735 | A | | 6/1989 | Oike |
| 4,858,443 | A | | 8/1989 | Denpou |
| 4,876,860 | A | | 10/1989 | Negishi |
| 4,897,778 | A | | 1/1990 | Miyamoto et al. |
| 4,966,010 | A | | 10/1990 | Jaster et al. |
| 5,018,357 | A | | 5/1991 | Livingstone et al. |
| 5,109,678 | A | | 5/1992 | Jaster et al. |
| 5,136,865 | A | | 8/1992 | Aoki et al. |
| 5,150,583 | A | | 9/1992 | Jaster et al. |
| 5,201,888 | A | | 4/1993 | Beach, Jr. et al. |
| 5,209,073 | A | * | 5/1993 | Thomas et al. ..... 62/186 X |
| 5,212,962 | A | | 5/1993 | Kang et al. |
| 5,220,806 | A | | 6/1993 | Jaster et al. |
| 5,231,847 | A | | 8/1993 | Cur et al. |
| 5,255,530 | A | | 10/1993 | Janke |
| 5,263,332 | A | | 11/1993 | Park |
| 5,269,152 | A | | 12/1993 | Park |
| 5,313,548 | A | | 5/1994 | Arvidson et al. |
| 5,326,578 | A | | 7/1994 | Yun |
| 5,355,686 | A | | 10/1994 | Weiss |
| 5,471,849 | A | | 12/1995 | Bessler |
| 5,476,672 | A | | 12/1995 | Kim |
| 5,758,512 | A | | 6/1998 | Peterson et al. |
| 5,778,688 | A | | 7/1998 | Park et al. |
| 5,799,496 | A | | 9/1998 | Park et al. |
| 5,821,708 | A | | 10/1998 | Williams et al. |
| 5,850,969 | A | | 12/1998 | Hong et al. |
| 5,884,491 | A | | 3/1999 | Kim et al. |
| 5,896,753 | A | | 4/1999 | Kwak et al. |
| 5,899,083 | A | * | 5/1999 | Peterson et al. ..... 62/187 X |
| 5,930,454 | A | | 7/1999 | Cho |
| 5,983,653 | A | * | 11/1999 | Lee ..... 62/186 |
| 6,055,820 | A | | 5/2000 | Jeong et al. |
| 6,138,460 | A | | 10/2000 | Lee |
| 6,196,011 | B1 | | 3/2001 | Bessler |
| 6,286,326 | B1 | | 9/2001 | Kopko |

* cited by examiner

*Primary Examiner*—Harry B. Tanner
(74) *Attorney, Agent, or Firm*—Karl Vick, Esq.; Damian Wasserbauer, Esq.; Armstrong Teasdale LLP

(57) ABSTRACT

A refrigeration control system containing a chamber in a fresh food compartment of a refrigerator. In one embodiment, a fan motor is positioned between an evaporator and the chamber. The fan motor speed or torque is adjusted to control the volume of cold evaporator air blown into the chamber. The rate of air flow to the chamber adjusts the temperature of the chamber.

33 Claims, 2 Drawing Sheets

METHOD AND APPARATUS FOR ADJUSTING TEMPERATURE USING AIR FLOW

BACKGROUND OF THE INVENTION

This invention relates generally to refrigerators, and more particularly, to controlling a temperature of cabinets in refrigerators.

Known household refrigerators include side-by-side, top mount, and bottom mount refrigerators. Such refrigerators may include a fresh food fan and a two-speed evaporator fan. These refrigerators include food preservation cabinets in a fresh food compartment. Typically the internal temperature of these cabinets is the same as the temperature of the fresh food compartment. Food placed within the cabinet after a period of time will be adjusted to the internal temperature of the cabinet. Typically refrigerators control cabinet temperature by monitoring control inputs such as outlet air and return air temperature of the cabinet. It is known to utilize a set rate of air flow to cool the cabinet. However, the amount of cooling provided by the single speed fresh food fan is limited by the speed of the fan.

BRIEF SUMMARY OF THE INVENTION

In one aspect, the present invention is a modular refrigeration control system that can be utilized in residential and commercial refrigerators.

In an exemplary embodiment, a method for controlling the temperature of a cabinet or chamber within a refrigerator includes controlling an amount of air flow to the chamber. In one embodiment, a fan motor is positioned between an evaporator and the chamber. A speed of the fan motor is adjusted to control the volume of cold evaporator air blown into the chamber. In an alternative embodiment, fan motor torque is adjusted to control the volume of air flow to the chamber. The rate of air flow to the chamber adjusts the temperature of the chamber.

DETAILED DESCRIPTION OF THE INVENTION

Figure 1:
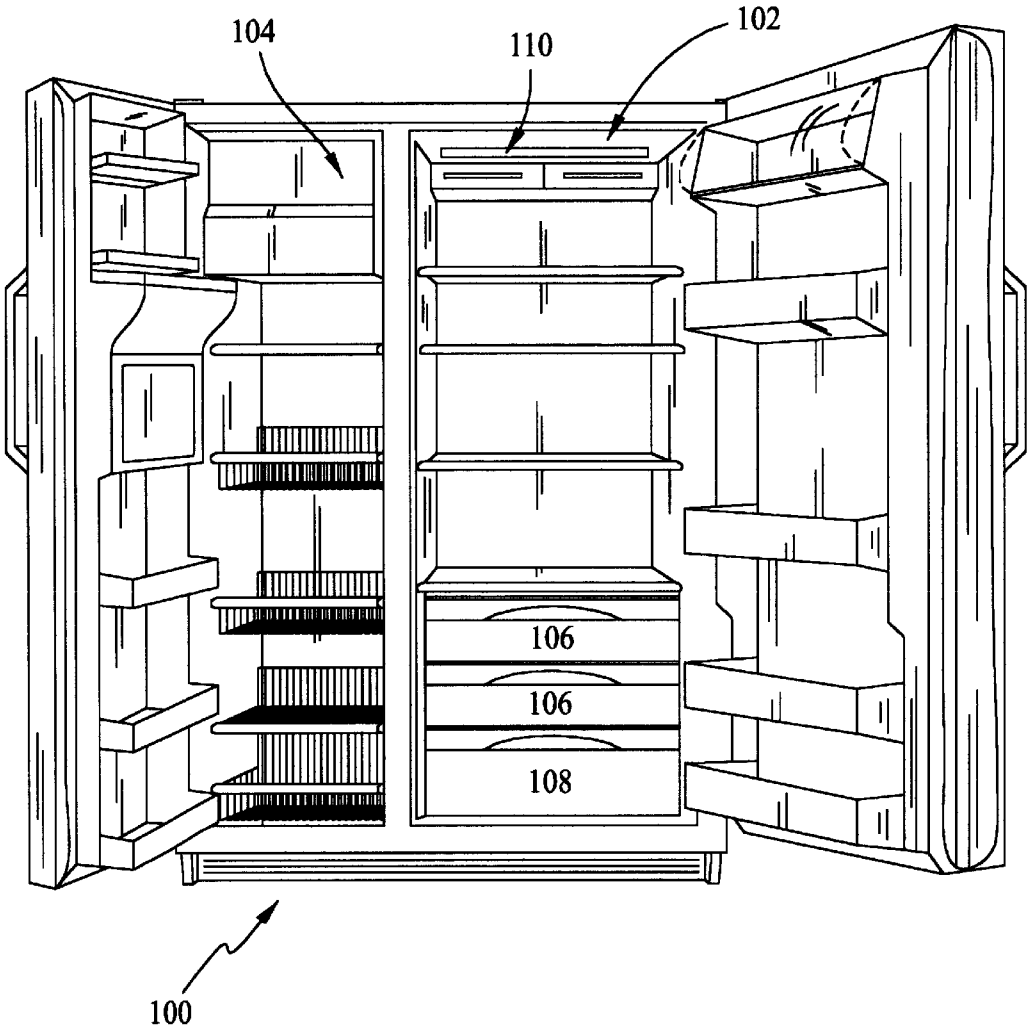
FIG. 1 is an illustration of a refrigerator with a chamber in a fresh food compartment.

FIG. 1 illustrates a side-by-side refrigerator 100 including a fresh food storage compartment 102 and a freezer storage compartment 104. Fresh food compartment 102 and freezer compartment 104 are arranged side-by-side. A side-by-side refrigerator such as refrigerator 100 is commercially available from General Electric Company, Appliance Park, Louisville, Ky. 40225.

Slide out drawers 106 are provided in fresh food compartment 102 to support items being stored therein. A bottom chamber, drawer or pan 108 whose temperature is controlled as described in detail below is provided in fresh food compartment 102. Bottom chamber 108 temperature is controlled according to user preferences via manipulation of a control interface 110 mounted in an upper region of fresh food storage compartment 102. In one embodiment, control interface 110 is electrically coupled to an electronic controller (not shown) to control the temperature of bottom chamber 108.

Figure 2:
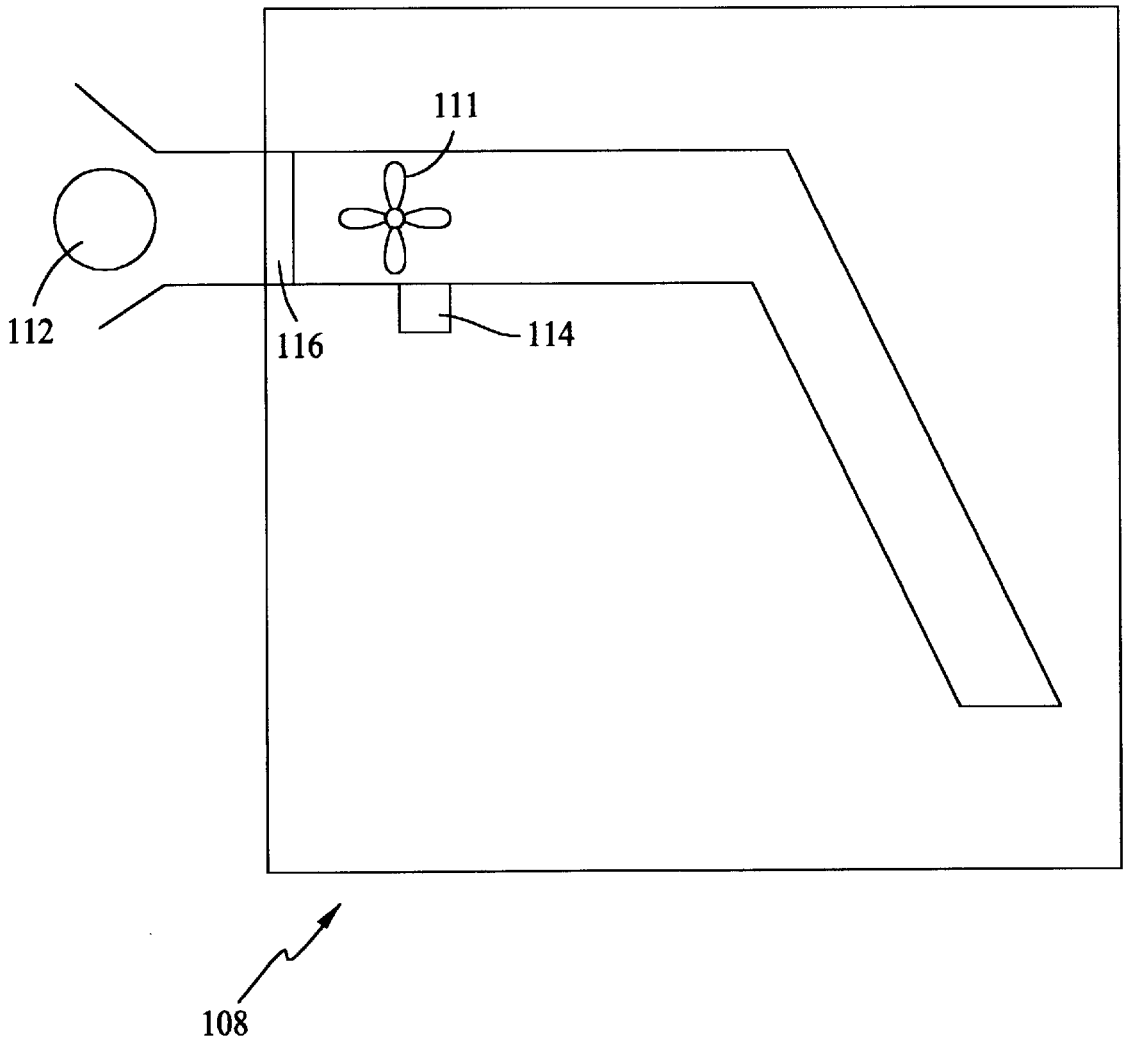
FIG. 2 is a schematic illustration of the chamber shown in FIG. 1.

FIG. 2 is a schematic illustration of chamber 108 in fresh food compartment 102. Chamber 108 contains a motor (not shown) connected to a fan 111 located ahead of an evaporator 112. In an alternative embodiment, fresh food compartment 102 includes a motor separate from the motor in chamber 108. A thermister 114 is located within chamber 108 to monitor a temperature of chamber 108. In one embodiment, the motor is positioned in a return air path of chamber 108 such that the air flowing over the motor is the air circulation in chamber 108, e.g., the motor is positioned in front of an evaporator in a return air stream. Chamber 108 in one embodiment includes a damper 116. When fan 111 is off, the temperature of chamber 108 is substantially equal to an operating temperature of fresh food compartment 102. Restricting the opening of damper 116 limits the supply of cold evaporator air to chamber 108, resulting in a higher temperature in chamber 108 reducing chilling efficacy.

Damper 116 is sized to achieve an air temperature and convection coefficient within chamber 108 with an acceptable pressure drop between freezer compartment 104 and chamber 108. In an exemplary embodiment, a temperature of fresh food compartment 102 is maintained at about 37° F., and freezer compartment 104 is maintained at about 0° F. An item placed into chamber 108 typically has a higher temperature than an ambient temperature of chamber 108. Since, an initial temperature of an item to be cooled affects a resultant chill time of the item: the chill time lengthens as the initial item temperature is increased. Chill time is predominately controlled by air temperature, air flow rate and convection coefficient parameters of chamber 108 to chill a given item to a desired target temperature.

In an exemplary embodiment, a fan speed of fan 111 connected to a motor (not shown) is controlled to increase or decrease air flow into chamber 108. A signal is supplied to the motor (not shown). In one embodiment, the signal is a temperature signal of a temperature in a return air stream. If the signal is present for a time period between TLOWERMIN<t<TLOWRMAX, the motor speed is increased by a predetermined value of RPM or CFM to increase air flow to chamber 108. In addition, if the signal is present for a time TLOWRMAX<t<THIGHMAX, then the motor speed is decreased by a predetermined RPM or CFM to decrease air flow to chamber 108. In an alternative embodiment, the motor torque can be increased or decreased to increase or decrease fan speed to adjust the constant air flow to chamber 108 depending on the signal received.

In a further alternative embodiment, the motor is located in a return air path ahead of an evaporator. An ambient temperature of chamber 108 and a temperature at the evaporator output are measured, and a signal is sent to the motor. The motor alters air flow to chamber 108 to achieve a desired temperature based on the signal received. In an alternative embodiment, the motor adjusts motor torque to alter the fan speed. For example, in one embodiment, the motor increases the air flow and in a further embodiment, the motor decreases air flow. The increase/decrease in fan speed in turn increases/decreases constant air flow to chamber 108. When the refrigerator is first powered-up, or when exiting a defrost cycle, a control algorithm delays the temperature measurements to allow for thermal settling time in the chamber.

In another embodiment, the refrigerator is a commercial refrigerator that includes cooling cases having an evaporator with one temperature compartment. The temperature compartment can be a frozen food display case where a door is opened to acquire frozen food. Alternatively, the temperature compartment is a fresh food cabinet where a display case contains air paths to cool food and air paths to form an air curtain in an open space in front of the compartment. The commercial refrigerator includes a fan motor positioned in a return air path such that ambient air flowing over the fan motor is fresh food air. The fan motor runs at low speed to provide constant air flow to the fresh food compartment. Alternatively, the fan motor provides constant air flow to the frozen food compartment. Control of the fan motor is located on the fan motor itself such that a thermister is not required. In a further embodiment, the fan motor turns on for a short period of time to sense a temperature of the return air.

In another embodiment chamber 108 is configured as a quick chill chamber. In one embodiment, the motor increases air flow to chamber 108 when a door is opened. The increased air flow provides additional cooling to offset warm air entering chamber 108 when the door is opened. Alternatively, air flow is increased when an object, e.g., food, having a temperature greater than an ambient temperature of fresh food compartment 102 is placed in chamber 108. Lastly, if the return air flow temperature increases, the motor increases air flow to chamber 108.

In one embodiment, a serial communications bus transmits to the fan motor speed or motor torque parameters. In a specific embodiment, the serial communications bus is an RS-232 bus, and in a further embodiment, the serial communications bus is electrically coupled to an electronic controller. In another embodiment, the motor fan is electrically connected to an electronic controller, which controls the motor fan speed. In a further embodiment, the motor fan is positioned in a return air stream and functions as a controller.

While the invention has been described in terms of various specific embodiments, those skilled in the art will recognize that the invention can be practiced with modification within the spirit and scope of the claims.

What is claimed is:

1. A method for controlling a temperature of a chamber in a fresh food compartment of a refrigerator, the refrigerator including a motor, a damper, an evaporator, a thermister, a fan, an electronic controller, and a serial communications bus, the thermister located in the chamber and the electronic controller electrically coupled to the damper, the serial communications bus, and the motor, the motor coupled to the fan, said method comprising the steps of:

supplying a signal regarding the chamber to the motor;

adjusting air flow to the chamber until a desired temperature is obtained; and maintaining a substantially constant air temperature in the chamber.

2. A method in accordance with claim 1 wherein said step of supplying a signal comprises the step of measuring an ambient temperature of the chamber.

3. A method in accordance with claim 1 wherein said step of adjusting air flow comprises the step of determining a period of time a signal is supplied to the motor.

4. A method in accordance with claim 3 wherein said step of adjusting air flow comprises the step of increasing air flow speed by at least one of a predetermined RPM value and a predetermined CFM value, when TLOWERMIN<t <TLOWRMAX, wherein TLOWERMIN is a lower time period, TLOWRMAX is an upper time limit, and t is a time the signal is present to the motor.

5. A method in accordance with claim 3 wherein said step of adjusting air flow comprises the step of decreasing air flow speed by at least one of a predetermined RPM value and a predetermined CFM value, when TLOWRMAX<t <THIGHMAX, wherein TLOWRMAX is a lower time period, THIGHMAX is an upper time limit, and t is a time the signal is present to the motor.

6. A method in accordance with claim 3 wherein said step of adjusting air flow comprises the step of adjusting the motor torque to adjust the fan speed based on a signal supplied to the motor.

7. A method in accordance with claim 6 wherein said step of adjusting air flow comprises the step of increasing motor torque to increase airflow to the chamber, when TLOWERMIN<t<TLOWRMAX, wherein TLOWERMIN is a lower time period, TLOWRMAX is an upper time limit, and t is a time the signal is supplied to the motor.

8. A method in accordance with claim 6 wherein said step of adjusting air flow comprises the step of decreasing motor torque to decrease airflow to the chamber, when TLOWRMAX<t<THIGHMAX, wherein TLOWRMAX is a lower time period, THIGHMAX is an upper time limit, and t is a time the signal is present to the motor.

9. A method in accordance with claim 1 wherein the motor is electrically coupled to a serial communications bus, said step of adjusting air flow comprises the step of receiving at least one of an airflow speed value, a motor torque value, an RPM value, and a CFM value from the serial communications bus to the motor.

10. A method in accordance with claim 1 wherein said step of adjusting air flow comprises the step of adjusting at least one of an air flow speed and a motor torque to achieve a desired temperature in the chamber.

11. A method in accordance with claim 1 wherein said step of adjusting air flow comprises the step of utilizing the controller to adjust at least one of an airflow speed and a motor torque to achieve a desired temperature in the chamber.

12. A method in accordance with claim 1 wherein said fan coupled to said motor is positioned in a return air flow to the chamber, said step of adjusting air flow comprises the step of the fan motor sensing a temperature of the return air flow.

13. A method in accordance with claim 12 wherein said step of adjusting air flow comprises the step of the fan motor increasing air flow speed.

14. A method in accordance with claim 1 wherein said step of supplying a signal comprises the step of supplying a temperature signal.

15. A method in accordance with claim 1 wherein the refrigerator comprises a commercial refrigerator.

16. A method in accordance with claim 1 wherein said step of adjusting air flow comprises the step of the motor increasing air flow to a quick chill chamber, when return air temperature increases.

17. A system to control a temperature of a chamber included in a fresh food compartment of a refrigerator, the system including a refrigerator having a motor, a damper, an evaporator, a thermister, a fan, an electronic controller, and a serial communications bus, said thermister located within the chamber and said electronic controller electrically coupled to said damper, said serial communications bus and said motor, said motor coupled to said fan, said system configured to:

supply a signal regarding the chamber to the motor;

adjust air flow to the chamber for a predetermined period of time; and maintain a substantially constant air temperature in the chamber.

18. A system in accordance with claim 17 wherein said thermister configured to measure an ambient temperature of said chamber.

19. A system in accordance with claim 17 wherein said controller configured to accept a temperature reading from said thermister.

20. A system in accordance with claim 19 wherein said motor is located in a return air path ahead of said evaporator, said controller configured to control at least one of an airflow speed and a motor torque to adjust the chamber temperature to a desired temperature based on the thermister temperature reading.

21. A system in accordance with claim 17 wherein said motor configured to accept a temperature signal.

22. A system in accordance with claim 17 wherein said motor configured to increase air flow speed by at least one of a predetermined RPM value and a predetermined CFM value, when TLOWERMIN<t<TLOWRMAX, wherein TLOWERMIN is a lower time period, TLOWRMAX is an upper time limit, and t is a time the signal is supplied to said motor.

23. A system in accordance with claim 17 wherein said motor configured to decrease air flow speed by at least one of a predetermined RPM value and a predetermined CFM value, when TLOWRMAX<t<THIGHMAX, wherein TLOWRMAX is a lower time period, THIGHMAX is an upper time limit, and t is a time the signal is supplied to said motor.

24. A method in accordance with claim 17 wherein said motor configured to adjust a motor torque to adjust the fan speed, when the signal is supplied to said motor.

25. A system in accordance with claim 24 wherein said motor configured to increase motor torque to increase air flow to said chamber, when TLOWERMIN<t<TLOWRMAX, wherein TLOWERMIN is a lower time period, TLOWRMAX is an upper time limit, and t is a time the signal is supplied to said motor.

26. A system in accordance with claim 24 wherein said motor configured to decrease air flow to said chamber by decreasing motor torque to decrease air flow to said chamber, when TLOWRMAX<t<THIGHMAX, wherein TLOWRMAX is a lower time period, THIGHMAX an upper time limit, and t is a time the signal is supplied to said motor.

27. A system in accordance with claim 17 wherein said motor configured to adjust air flow to the chamber by receiving at least one of a motor speed, an RPM value, a CFM value, an air flow rate, and a motor torque value from said serial communications bus.

28. A system in accordance with claim 27 wherein said serial communications bus is a RS-232 bus.

29. A system in accordance with claim 17 wherein said motor configured to measure an ambient temperature and to adjust at least one of an airflow speed and a motor torque to achieve a desired temperature in said chamber.

30. A system in accordance with claim 18 wherein said controller is configured to execute a control algorithm.

31. A system in accordance with claim 17 wherein said refrigerator comprises a commercial refrigerator.

32. A system in accordance with claim 17 wherein said chamber is configured as a quick chill chamber.

33. A system in accordance with claim 32 wherein said motor configured to increase air flow to said quick chill chamber, when return air temperature increases.

* * * * *